United States Patent [19]

Woodring et al.

[11] 4,275,997

[45] Jun. 30, 1981

[54] HYDRAULIC PUMP WITH PROPORTIONAL PRESSURE CONTROLLER

[75] Inventors: Richard H. Woodring; Charles H. Whitmore, both of Plainwell; Paul K. Houtman, Kalamazoo; Thomas A. Kowalski, Paw Paw, all of Mich.

[73] Assignee: Parker-Hannifin Corporation, Cleveland, Ohio

[21] Appl. No.: 65,298

[22] Filed: Aug. 9, 1979

[51] Int. Cl.[3] ..... F04B 49/00

[52] U.S. Cl. ..... 417/218; 60/445; 251/61.1; 251/122

[58] Field of Search ..... 417/218–222, 417/212; 60/446, 445; 251/61.1, 122

[56] References Cited

U.S. PATENT DOCUMENTS

| | | | |
|---|---|---|---|
| 2,338,021 | 12/1943 | Bennett . | |
| 2,393,172 | 1/1946 | Larreco . | |
| 3,067,693 | 12/1962 | Lambeck | 417/219 |
| 3,282,556 | 11/1966 | Hancook | 251/122 |
| 3,549,281 | 12/1970 | Schink et al. . | |
| 3,659,625 | 5/1972 | Coiner et al. | 251/61.1 X |
| 3,716,346 | 2/1973 | Greene | 251/122 X |
| 3,748,857 | 7/1973 | Heiser | 60/445 X |
| 3,959,969 | 6/1976 | Tittmann et al. | 60/445 |

*Primary Examiner*—Carlton R. Croyle
*Assistant Examiner*—Edward Look
*Attorney, Agent, or Firm*—James A. Baker

[57] ABSTRACT

A fluid pressure system includes a source of water pressure 12, a first fluid motor 27 actuated by the pressurized water, a variable displacement hydraulic pump 11, and a second fluid motor 14 actuated by hydraulic fluid from the pump. The pump includes a control device 20 having a control chamber for changing the displacement of the pump. A proportional valve 17 is hydraulically connected to the control chamber for changing the pressure in the control chamber. The proportional valve includes a housing 34, 35 and a diaphragm 36 dividing the housing into first and second chambers 39 and 41. The first chamber is connected to the first fluid motor, and the second chamber is connected to the pump inlet. The pump control chamber is hydraulically connected to the second chamber through a variable orifice, and the size of the orifice is changed in response to the pressure in the first chamber and first fluid motor. By this arrangement, the variable displacement pump is controlled by the water pressure in the first fluid motor.

7 Claims, 2 Drawing Figures

HYDRAULIC PUMP WITH PROPORTIONAL PRESSURE CONTROLLER

BACKGROUND OF THE INVENTION

The present invention relates generally to fluid power systems, and more particularly to a fluid power system which includes two fluid power circuits and a means for controlling the pressure in one of the circuits in response to the pressure in the other circuit. Still more particularly, the invention relates to such a fluid power system for use in a dewatering filter press.

Dewatering filter presses are used to remove excess water from a slurry. In such filter presses, water pressure acts against a diaphragm to squeeze the water from the slurry while hydraulic pressure acts against a piston to provide a clamping force holding the press closed. In this type of press, the magnitude of the clamping force, and hence the magnitude of the hydraulic pressure in the clamping piston, must be proportional to the water pressure acting against the diaphragm. In the prior art, this is accomplished by using several pressure activated switches that are responsive to the water pressure acting against the diaphragm. This arrangement produces a clamping pressure that is not a linear function of the water pressure but instead is a stair step function of the water pressure.

SUMMARY OF THE INVENTION

The present invention departs from these and other prior art fluid power systems and presses by providing a fluid power system which includes a first fluid motor, a source of pressurized water for the first fluid motor, a second fluid motor, and a variable displacement hydraulic pump having an outlet hydraulically connected to the second fluid motor. A control device for changing the displacement of the pump includes a control chamber and a proportional valve. The proportional valve includes a housing and a diaphragm separating the housing into first and second chambers. The first chamber is connected to the first fluid motor, and the pump control chamber is hydraulically connected to the second chamber through a variable orifice. The size of the variable orifice, and hence the pressure in the pump control chamber, is changed as a function of the water pressure in the first chamber and first fluid motor.

By this arrangement, the outlet pressure of the hydraulic pump supplied to the second fluid motor is a linear function of the operating pressure in the first fluid motor. The ratio of changes in hydraulic oil pressure to changes in water pressure can be changed by varying the thickness or material of the diaphragm, the diaphragm area exposed to water pressure, and the diaphragm area exposed to hydraulic pressure. Additionally, by adjusting the seat of the variable orifice, the null pressure of the pump (that is, the outlet pressure of the pump maintained by the proportional valve in the absence of water pressure) can also be changed. Still further, by a particular arrangement of passages in the seat, the seat can be adjusted without having to disconnect any of the fluid connections in the system.

BRIEF DESCRIPTION OF THE DRAWINGS

These and other aspects and advantages of the invention are incorporated in the preferred embodiment of the invention shown in the accompanying drawings, wherein: p

DETAILED DESCRIPTION OF THE DRAWINGS

Figure 1:
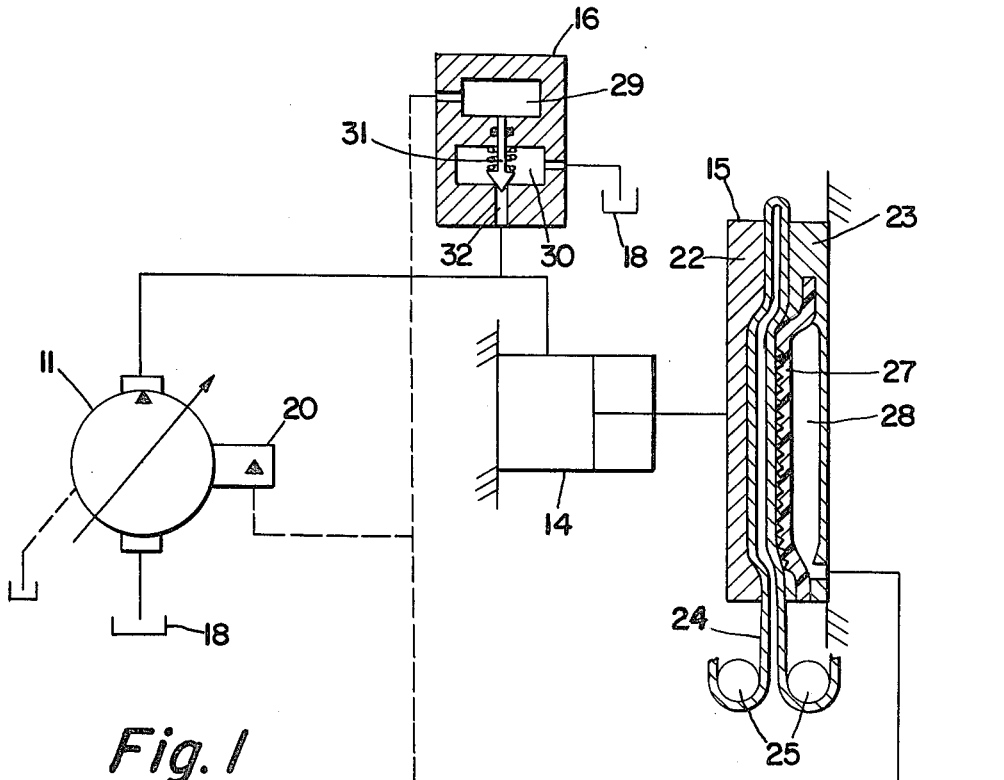
FIG. 1 is a diagram of the system according to the principles of the invention, with the proportional valve and press and pilot-operated relief valve shown in cross section.

Referring now to the drawings in greater detail, FIG. 1 illustrates a fluid power system having a hydraulic pump 11 and a source of water pressure 12. The pump 11 supplies fluid to a hydraulic cylinder 14 through a suitable directional control valve (not shown) to advance and retract the piston of the cylinder 14. The cylinder 14 is a part of a press 15 and is provided to open and close a cavity of the press. A pilot-operated relief valve 16 is also hydraulically connected to the outlet of the pump 11, and a proportional valve 17 is provided to control the pump 11. A reservoir 18 provides a source of hydraulic oil for the circuit shown in FIG. 1.

The pump 11 is a well-known remote pressure compensated variable displacement pump. In the preferred embodiment, the pump 11 is a piston pump having a variable displacement flow generating mechanism and a control 20 for changing the displacement rate of the flow generating mechanism in a well-known manner. The control 20 includes a variable volume control chamber arranged in a well-known manner so that increases in pressure in the control chamber cause a corresponding increase in outlet pressure in the pump 11, while decreases in pressure in the control chamber cause a corresponding decrease in the outlet pressure of the pump 11. The control device 20 is constructed and arranged so that the outlet pressure of the pump 11 is always maintained at a predetermined fixed pressure differential (approximately 200 psi in the preferred embodiment) above the pressure in the control chamber.

The press 15 is a well-known dewatering filter press for removing excess water from a slurry. The press 15 includes a movable housing portion 22 and a stationary housing portion 23. A filter cloth 24 is fed between the housing portions 22 and 23 by rollers 25, and the filter cloth 24 defines a slurry chamber 26 between the two housing portions. A flexible diaphragm 27 separates the slurry chamber 26 from a water chamber 28.

At the beginning at a work cycle for the press 15, the chamber 26 is filled with slurry and the diaphragm 27 is in a righward position so that the chamber 26 is in a maximum volume condition while the chamber 28 is in a minimum volume condition. Water pressure from the source 12 is fed into the chamber 28 to act against the diaphragm 27 to begin squeezing excess water from the slurry in the chamber 26. As the excess water is removed from the chamber 26, the water pressure in the chamber 28 is increased and the diaphragm 27 moves to the left until the slurry chamber 26 is in its minimum volume position and the water chamber 28 is in its maximum volume position as illustrated in FIG. 1. The water pressure in the chamber 28 is then released, and the piston of the cylinder 14 is retracted to the left to move the housing portion 22 away from the housing portion 23. This opens the slurry chamber 26 and permits removal of the remaining materials from the chamber 26. The filter cloth 24 is then washed, and the piston of the cylinder 14 is advanced to the right to close the housing portion 22 against the housing portion 23 and permit another work cycle to be performed. In the preferred embodiment, the press 15 is a Lasta automatic filter press manufactured by Ingersoll-Rand Corporation of Nashua, New Hampshire.

The pilot operated relief valve 16 includes a pilot chamber 29 hydraulically connected to the control chamber of the control device 20 and a relief chamber 30 hydraulically connected to the reservoir 18. A dart 31 connects a port 32 to the relief chamber 30 and reservoir 18 whenever the pressure in the port 32 is sufficient to overcome the preload of spring 31 and the force created by the pressure in the pilot chamber 29. The pilot operated relief valve 16 provides a device for releasing the pressure in the cylinder 14 when the pressure in the control chamber of the control device 20 decreases. This is accomplished by the resulting decreased pressure in the pilot chamber 29 permitting the poppet 31 to open and direct fluid pressure from the cylinder 14 to the reservoir 18.

The proportional valve 17 includes a first housing portion 34 and a second housing portion 35. The housing portions 34 and 35 are secured together by suitable axially extending bolts (not shown), and each housing portion has a square lateral cross sectional configuration. The housing portion 34 is preferably of stainless steel so that it resists rust when subjected to water, while the housing portion 35 is preferably of ordinary carbon steel. A flexible stainless steel diaphragm 36 is sandwiched between the housing portions, and suitable O-ring seals 37 and 38 are provided to prevent fluid leakage between the diaphragm 36 and the housing portions.

A first fluid chamber 39 is provided in the first housing portion 34 and is in fluid pressure communication with the source 12 and water chamber 28 through a sensing port 40. A second fluid chamber 41 is provided in the second housing portion 35 and is in fluid pressure communication with the reservoir 18 through a drain port 42.

A hardened steel spool or seat 46 is threaded into an enlarged diameter threaded end portion of an axial bore 47 in the housing portion 35. The seat 46 includes a passage 48 having an axially extending passage portion extending part way through the spool 46 from its right end face and a radially extending passage portion extending from the axial portion to the outer peripheral surface of the seat 46. The radially extending passage portion communicates with a control port 49, and suitable O-ring seals on each side of the radially extending passage portion prevent fluid leakage between the spool 46 and the bore 47. A lock nut 50 is provided to prevent rotation of the seat 46 after it is properly positioned in the bore 47.

The diaphragm 36 includes a dart 51 which cooperates with the right end of the spool 46 to define a variable orifice. By this arrangement, the control chamber of the control device 20 is connected to the second chamber 41 and reservoir 18 through a variable orifice, and the size of the orifice is a function of the water pressure in the chamber 39. Thus, as the water pressure in the chamber 39 increases, the diaphragm 36 is urged to the left to tend to close the variable orifice. This restricts the flow of fluid from the control chamber of the control device 20 and causes an increase in pressure in the control chamber and a corresponding increase in outlet pressure of the pump 11. When the water pressure in the second chamber 39 decreases, the decreased water pressure permits the diaphragm 36 to be urged to the right to increase the size of the variable orifice. This causes a decrease in the pressure in the control chamber and a corresponding decrease in the outlet pressure of the pump 11.

Figure 2:
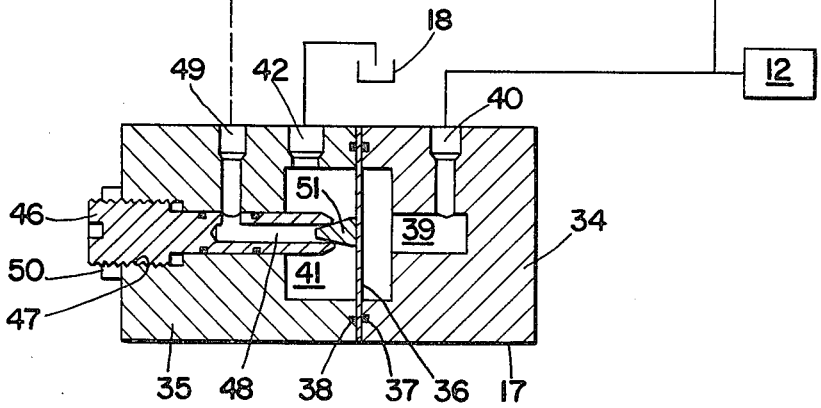
FIG. 2 is a graphical representation of the relationship between water pressure and hydraulic oil pressure in the system shown in FIG. 1.
Figure 2:
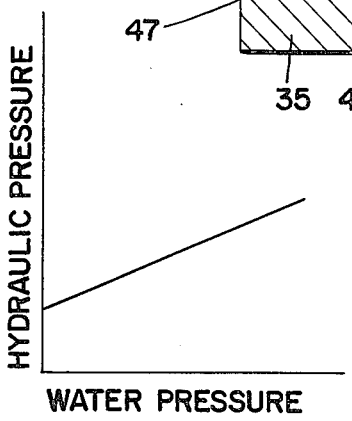

By this arrangement, the clamping pressure in the cylinder 14 provided by the pump 11 is controlled by the water pressure in the chamber 28 of the press 15. Thus, when the water pressure in the chamber 28 increases or decreases, there is a proportional increase or decrease in the clamping pressure in the cylinder 14. The relationship between the water pressure in the chamber 28 and the hydraulic oil pressure in the control chamber of the control device 20 is illustrated in FIG. 2. By varying the cross sectional area of the diaphragm 36 exposed to water pressure in the chamber 39 and the cross sectional area of the dart 51 exposed to hydraulic pressure and the material and thickness of the diaphragm 36, the proportional relationship between changes in water pressure and changes in hydraulic pressure can be altered. Additionally, by threading the seat 46 further in or further out of the bore 47, the hydraulic pressure in the control chamber of the control device 20 when there is zero gauge pressure in the chamber 39 (this hydraulic pressure is called "null pressure") can also be changed. This adjusting movement of the seat 46 is accomplished without requiring alteration or disconnection of any fittings in the system.

What is claimed is:

1. A pump comprising a variable displacement flow generating means, control means for changing the displacement rate of said flow generating means, said control means including a control chamber, a proportional valve hydraulically connected to said control chamber for changing the pressure in said control chamber, said proportional valve including a housing, separator means disposed in said housing and defining first and second chambers, a first fluid in said first chamber and a second fluid in said second chamber, said first fluid being different from said second fluid, means hydraulically connecting said control chamber with said second chamber through a variable orifice, and means to change the size of said orifice in response to the pressure in said first chamber.

2. A pump according to claim 1, said separator means being a diaphragm having one side exposed to said first fluid and another side exposed to said second fluid.

3. A pump according to claim 2, including a drain port hydraulically connected to said second chamber.

4. A pump according to claim 3, said variable orifice including a plug adjustably mounted in said housing for axial movement toward and away from said diaphragm.

5. A pump according to claim 4, said plug having a passage, said passage including an axially extending portion extending from one end of said plug only part way through said plug, and said passage including a radially extending portion extending from said axial portion to the outer peripheral surface of said plug.

6. A pump according to claim 1, including a reservoir, a pilot operated relief valve, said relief valve having a pilot chamber hydraulically connected to said control chamber, and valve means responsive to pressure in said pilot chamber for hydraulically connecting the outlet of said pump to said reservoir.

7. A pump comprising a variable displacement flow generating means, control means for changing the displacement rate of said flow generating means, said control means including a control chamber, a proportional valve hydraulically connected to said control chamber for changing the pressure in said control chamber, said proportional valve including a housing, a flexible diaphragm disposed in said housing and defining first and second chambers, a pressure sensing port hydraulically connected to said first chamber, a drain port hydraulically connected to said second chamber, an adjustable plug mounted for axial adjusting movement toward and away from said diaphragm, a fluid passage in said plug hydraulically connected to said control chamber and terminating at an end of said plug near said diaphragm, and said end of said plug and said diaphragm cooperatively defining an adjustable variable orifice means for metering fluid flow from said control chamber and passage to said second chamber.

* * * * *